US005727947A

United States Patent [19]

Esterle

[11] Patent Number: 5,727,947

[45] Date of Patent: Mar. 17, 1998

[54] HAND TOY WITH MOVABLE RODS AND RING ELEMENTS

[76] Inventor: Richard B. Esterle, 605 E. 11th St., Apt. 1A, New York, N.Y. 10009

[21] Appl. No.: 815,976

[22] Filed: Mar. 10, 1997

[51] Int. Cl.[6] ..... A63H 33/00; G09B 19/00

[52] U.S. Cl. ..... 434/258; 446/489

[58] Field of Search ..... 446/489, 418; 434/258, 259, 278, 281, 277

[56] References Cited

U.S. PATENT DOCUMENTS

| | | | |
|---|---|---|---|
| 2,225,612 | 12/1940 | Allen . | |
| 2,380,273 | 7/1945 | Taplan | 446/418 |
| 2,843,971 | 7/1958 | Gardellin . | |
| 3,230,643 | 1/1966 | Mathus . | |
| 3,360,883 | 1/1968 | Glanzer . | |
| 3,611,620 | 10/1971 | Perry . | |
| 3,710,504 | 1/1973 | Rylands | 446/489 |
| 3,950,888 | 4/1976 | Hogan . | |
| 4,170,106 | 10/1979 | Koslosky . | |
| 4,485,585 | 12/1984 | Shackelford | 434/258 |
| 4,698,023 | 10/1987 | Marino | 434/289 |
| 4,702,702 | 10/1987 | Mikelsaar . | |
| 4,877,406 | 10/1989 | Wilk | 434/278 |
| 5,009,625 | 4/1991 | Longuet-Higgins . | |
| 5,030,103 | 7/1991 | Buist et al. | 434/281 |
| 5,316,483 | 5/1994 | Esterle . | |
| 5,395,279 | 3/1995 | McCann | 446/489 |
| 5,562,519 | 10/1996 | Loewenton . | |

FOREIGN PATENT DOCUMENTS

| | | | |
|---|---|---|---|
| 1345514 | 12/1963 | France | 434/278 |

*Primary Examiner*—Paul J. Hirsch
*Attorney, Agent, or Firm*—Kurt R. Benson

[57] ABSTRACT

A hand toy for improving the fine motor skills of a young child includes a central hub having a plurality of angled openings passing therethrough such that the openings do not intersect one another. The hand toy further includes a plurality of elongate rods each respectively slidably received within one of the openings in the central hub. The terminal ends of the rods extend outwardly from the hub and the rods are slidably movable relative to the central hub without noticeable friction. Each end of the rods has an enlarged stopper element mounted thereon to limit the sliding movement of the rods relative to the hub to prevent the rods from becoming disassembled from the hub during use. The hand toy still further includes a plurality of differently shaped and differently colored ring members which are received on the rods and slidably movable between the central hub and the stopper element at the respective end of the rod.

19 Claims, 3 Drawing Sheets

HAND TOY WITH MOVABLE RODS AND RING ELEMENTS

BACKGROUND AND SUMMARY OF THE INVENTION

The instant invention relates to toys for young children, and more particularly to a hand toy having multiple movable elements which allows the child to manipulate the movable elements of the toy and thereby increase fine motor skills.

Toys which help develop the motor skills of young children are well known in the art. However, there is always an ongoing need, and consumer desire, for new and amusing toys to educate and help develop the motor skills of young children.

In this regard, the instant invention provides a novel hand toy for improving the fine motor skills of a young child comprising a central spherical hub having a plurality of openings passing therethrough such that the openings do not intersect one another, and further comprising a plurality of elongate rods each respectively slidably received within one of the openings in the central hub. The terminal ends of the rods extend outwardly from the hub and the rods are slidably movable relative to the central hub without noticeable friction between the rods and the hub. The openings in the hub are preferably angled to each other such that the plurality of rods extend outwardly from the hub in a generally uniformly spaced arrangement. Each end of the rods has an enlarged stopper element mounted thereon to limit the sliding movement of the rods relative to the hub to prevent the rods from becoming disassembled from the hub during use. The hand toy still further includes a plurality of differently shaped and differently colored ring members which are received on the end portions of the rods and are slidably movable between the central hub and the stopper element at the respective end of the rod.

Accordingly, among the objects of the instant invention are: the provision of a hand toy which will help develop the fine motor skills of young children; the provision of a hand toy including a hub and a plurality of rods which are received through openings in the hub and are slidably movable relative to each other and relative to the hub; the provision of such a hand toy further including a plurality of ring members which are received on the rods and slidably movable between the central hub and the stopper elements at the terminal ends of the rods; the provision of such a hand toy wherein the ring members are fashioned in different geometric shapes and different colors.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
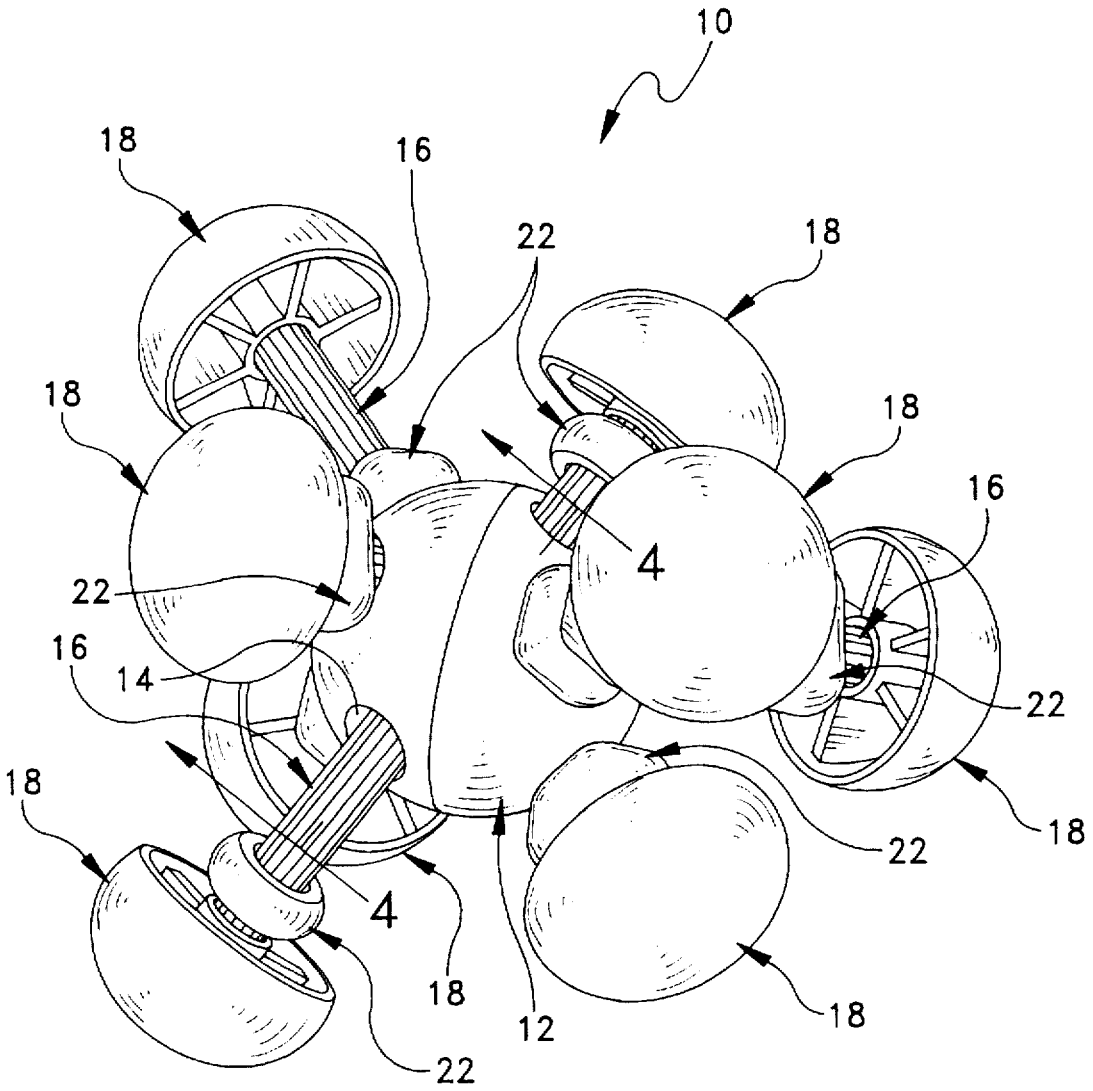
FIG. 1 is a perspective view of the hand toy of the instant invention.
Figure 2:
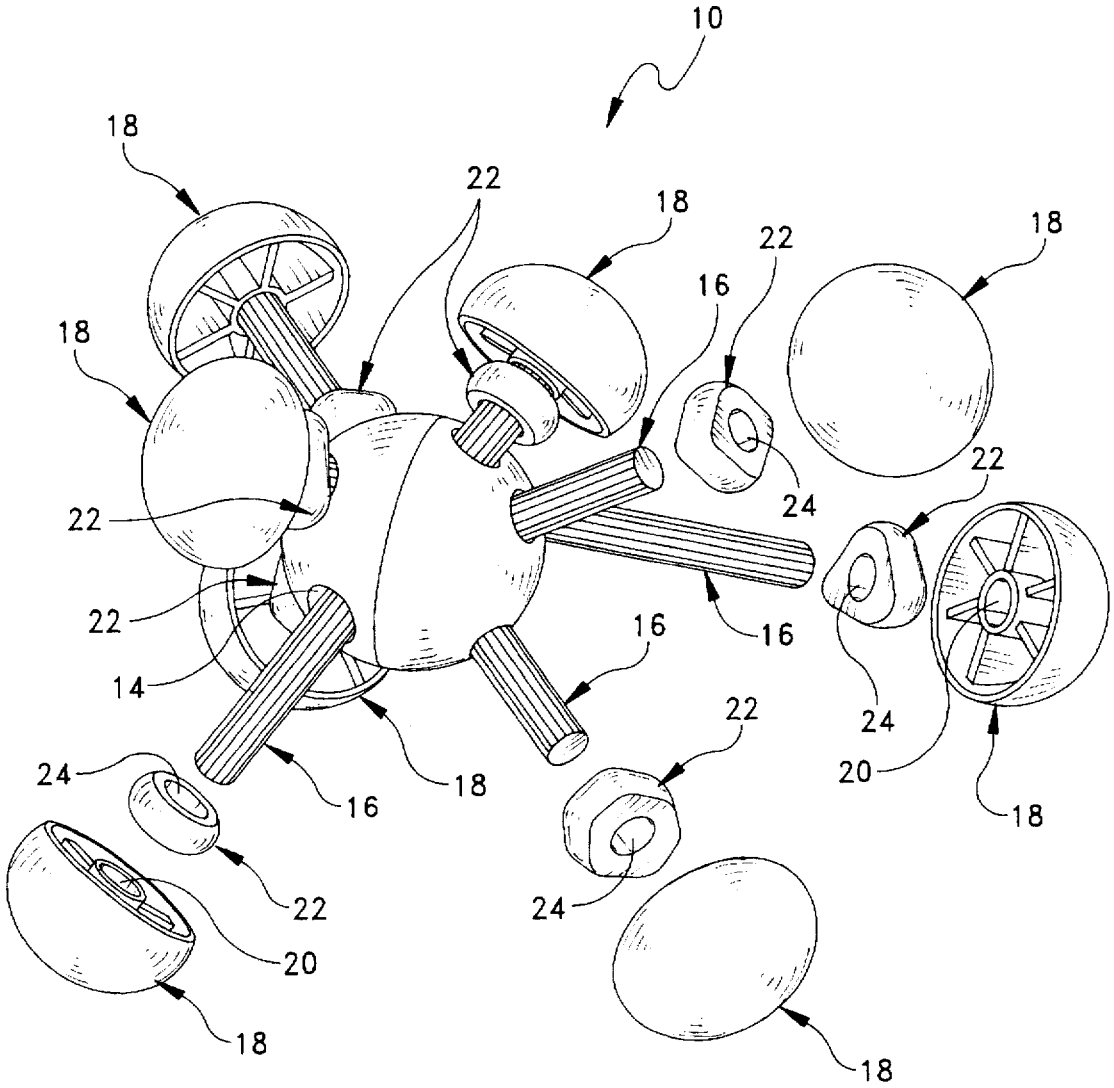
FIG. 2 is a partially exploded perspective view thereof.

Referring now to the drawings, the hand toy of the instant invention is illustrated and generally indicated at 10 in FIGS. 1–2. As will hereinafter be more fully described, the instant hand toy 10 includes multiple movable elements which are intended to encourage manipulation of the movable elements and thereby improve fine motor skills.

The hand toy comprises a central hub generally indicated at 12 having a plurality of openings 14 passing therethrough, and further comprises a plurality of elongate rods generally indicated at 16, each of which is respectively slidably received within a corresponding one of the openings 14 in the central hub 12.

Figure 3:
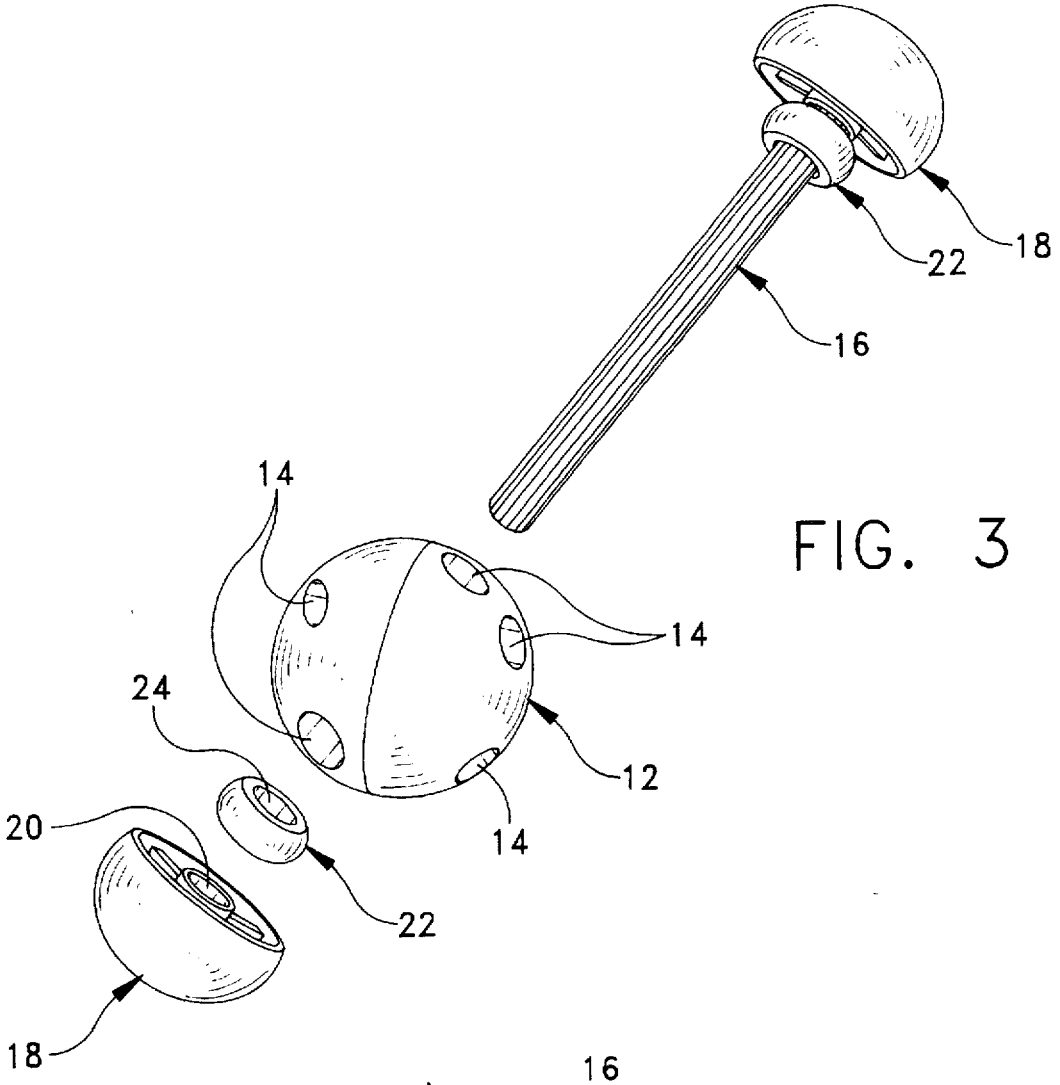
FIG. 3 is an exploded perspective view of the hub and a single rod element.
Figure 4:
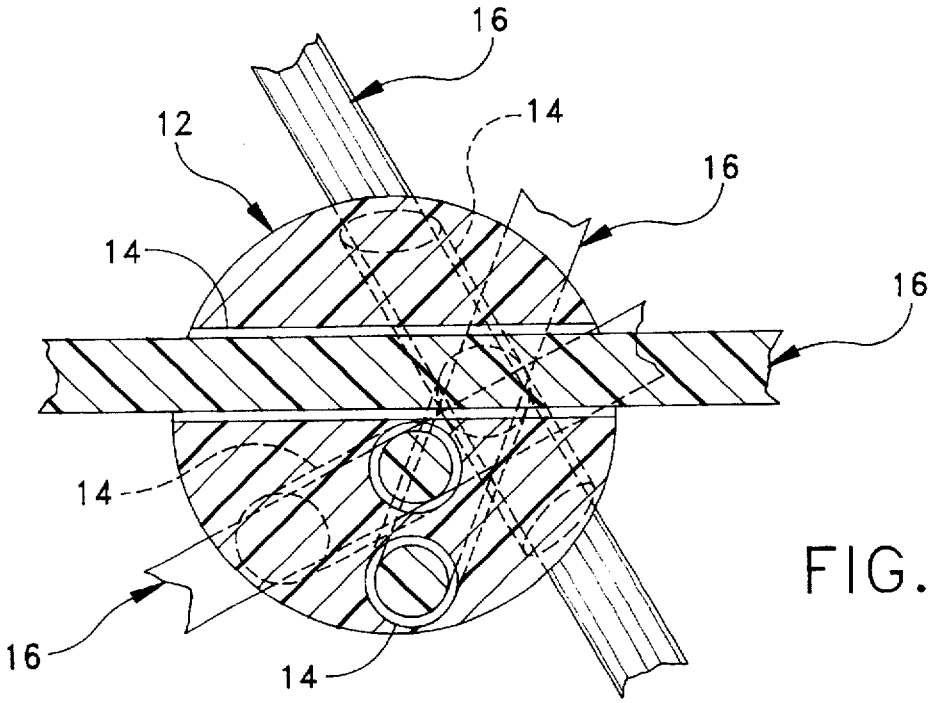
FIG. 4 is a cross-sectional view of the hand toy taken along line 4—4 of FIG. 1.

The hub 12 preferably comprises solid spherical body wherein the openings 14 pass through the hub 12 without intersecting one another. The elongate rods 16 are preferably cylindrical in configuration and generally have a length which is about 2.5 times the width (diameter) of the hub 12 such that the terminal ends of the rods extend outwardly from the hub 12. The openings 14 in the hub 12 are also preferably cylindrical in shape to receive the rods 16 in mating relation. In this regard, the rods 16 have a cylindrical diameter which is slightly less than the diameter of the openings 14 such that the rods 16 are freely slidably movable relative to the central hub 12 without noticeable friction between the rods 16 and the hub 12. The openings 14 in the hub 12 are also preferably angled to each other such that the plurality of rods 16 extend outwardly from the hub 12 in a generally uniformly spaced arrangement. Each end of the rods 16 includes an enlarged hemispherical stopper element generally indicated at 18 mounted thereon. More specifically, the stopper elements 18 include a central bore 20 (FIGS. 2 and 3) into which the respective ends of the rods 16 are received in secure interfitting relation such that they cannot be disassembled. The enlarged size of the stopper elements 18 limit the sliding movement of the rods 16 relative to the hub 12 and prevents the rods 16 from becoming disassembled from the hub 12 during use. The hand toy 10 still further includes a plurality of differently shaped and differently colored ring members generally indicated at 22 which are received on the end portions of the rods 16 and are slidably movable between the central hub 12 and the stopper element 18 at the respective end of the rod 16. Each of the rings 22 has a central opening 24 with an inner diameter which is substantially greater than the outer diameter of the rods 16 to allow free sliding and rotation of the rings 22 relative to the rods 16. Each of the above-described elements is preferably molded from a durable, rigid plastic which is capable of withstanding the day to day use by children.

In the present embodiment, with a spherical hub 12, uniformly spaced and dimensioned rods 16, and hemispherical stopper elements 18, the hand toy 10 substantially resembles a fanciful atom with swirling electrons. In use, a small child can easily grasp the many different movable elements, and manipulate the movable elements, i.e. rotate the toy 10, slide the rods 16, move the rings 22, etc. In particular, when the hand toy 10 is rotated around, the slidable rods 16 freely slide through the openings 14 by gravitational forces without noticeable friction between the rods 16 and hub 12. The terminal ends of the rods 16 are therefore freely and independently movable relative to each other and relative to the hub 12. The rings 22 also slide back and forth along the length of the rods 16 to further enhance the movement effects. This type of freely sliding, unrestricted movement encourages the child to explore and further manipulate the elements to determine how the device functions.

It can therefore be seen that the instant invention provides a unique and novel hand toy 10 which will help develop the fine motor skills of young children. The provision of a plurality of slidably movable rods 16, and a plurality of slidably movable differently shaped and colored ring members 22 received on the rods encourages manipulation of the multiple elements to thereby achieve the objectives of the instant invention. For these reasons, the instant invention is believed to represent a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. In particular, it is to be understood that each of the noted elements could be fashioned in other geometric shapes and configurations without departing from the spirit of the invention. For example, the central hub 12 could alternatively be fashioned as a shell with a hollow interior, and furthermore could be fashioned in virtually any geometric or decorative shape desired by the end user. Furthermore, the rods 16 and corresponding openings 14 could be fashioned as having other than a cylindrical shape, i.e. other than a circular cross-section. For example, the rods 16 and openings 14 could have square cross-sections. Still further, the specific shapes and color of the ring elements 22 could be changed and interchanged without any detrimental effect to the functioning of the device.

What is claimed is:

1. A hand toy comprising:

a central hub having a plurality of openings passing therethrough wherein said plurality of openings do not intersect one another; and a plurality of elongate rods each respectively slidably received within a corresponding one of the openings in the central hub, said rods having opposing terminal ends which extend outwardly from said hub, each rod having a stopper element at the respective terminal ends thereof, said plurality of rods being slidably movable along their respective lengths thereof relative to the central hub, said stopper elements limiting sliding movement of the terminal ends of the rods relative to the hub to prevent said rods from becoming disassembled from the hub.

2. The hand toy of claim 1 wherein said plurality of openings extend at angles to each other.

3. The hand toy of claim 2 wherein said plurality of openings extend at angles to each other such that said plurality of rods extend outwardly of from hub in a generally uniformly spaced arrangement.

4. The hand toy of claim 2 wherein there are at least three openings and three corresponding rods.

5. The hand toy of claim 4 wherein there are four openings and four rods.

6. The hand toy of claim 1 wherein each of said rods is freely slidable relative to the hub without noticeable friction interference between said rods and said hub.

7. The hand toy of claim 1 wherein the terminal ends of said rods are independently movable relative to the free ends of adjacent rods.

8. The hand toy of claim 1 further comprising at least one ring member received on one of the rods and slidably movable along the rod between the central hub and the stopper element on the respective end of the rod.

9. The hand toy of claim 8 further comprising a plurality of ring members which are received on the rods and slidably movable between the central hub and the stopper element at the respective end of the rod.

10. The hand toy of claim 2 wherein each of said rods is freely slidable relative to the hub without noticeable friction interference between said rods and said hub.

11. The hand toy of claim 10 wherein the terminal ends of said rods are independently movable relative to the free ends of adjacent rods.

12. The hand toy of claim 11 further comprising at least one ring member received on one of the rods and slidably movable along the rod between the central hub and the stopper element on the respective end of the rod.

13. The hand toy of claim 3 wherein each of said rods is freely slidable relative to the hub without noticeable friction interference between said rods and said hub.

14. The hand toy of claim 13 wherein the terminal ends of said rods are independently movable relative to the free ends of adjacent rods.

15. The hand toy of claim 14 further comprising at least one ring member received on one of the rods and slidably movable along the rod between the central hub and the stopper element on the respective end of the rod.

16. The hand toy of claim 2 wherein the terminal ends of said rods are independently movable relative to the free ends of adjacent rods.

17. The hand toy of claim 16 further comprising at least one ring member received on one of the rods and slidably movable along the rod between the central hub and the stopper element on the respective end of the rod.

18. The hand toy of claim 3 wherein the terminal ends of said rods are independently movable relative to the free ends of adjacent rods.

19. The hand toy of claim 18 further comprising at least one ring member received on one of the rods and slidably movable along the rod between the central hub and the stopper element on the respective end of the rod.

* * * * *